United States Patent [19]

Coha et al.

[11] Patent Number: 4,945,884

[45] Date of Patent: Aug. 7, 1990

[54] MODULAR FUEL DELIVERY SYSTEM

[75] Inventors: Timothy F. Coha, Davison; Richard F. Kostelic, Flint; Gregory K. Rasmussen, Grand Blanc, all of Mich.

[73] Assignee: General Motors Corporation, Detroit, Mich.

[21] Appl. No.: 426,631

[22] Filed: Oct. 24, 1989

[51] Int. Cl.[5] ..... F02M 37/10

[52] U.S. Cl. ..... 123/509; 123/514; 137/590; 137/565; 137/592; 137/574

[58] Field of Search ..... 123/509, 514, 516, 518, 123/519, 510; 137/590, 565, 592, 434, 558, 572, 574, 576; 417/40; 220/855

[56] References Cited

U.S. PATENT DOCUMENTS

| | | | |
|---|---|---|---|
| 2,945,509 | 7/1960 | Tuttle | 137/576 |
| 3,049,171 | 8/1962 | Neuerburg | 137/590 |
| 3,254,905 | 11/1967 | Lewis | 137/590 |
| 3,726,310 | 4/1973 | Coscia | 137/576 |
| 4,546,750 | 10/1985 | Brunell et al. | 123/514 |
| 4,651,701 | 3/1987 | Weaver | 123/509 |
| 4,672,937 | 6/1987 | Fales et al. | 123/509 |
| 4,706,707 | 11/1987 | Betterton et al. | 137/565 |
| 4,747,388 | 5/1988 | Tuckey | 123/514 |
| 4,750,522 | 6/1988 | Griffin | 123/514 |
| 4,776,315 | 10/1988 | Greiner | 123/509 |
| 4,807,582 | 2/1989 | Tuckey | 123/514 |
| 4,831,990 | 5/1989 | Tuckey | 123/514 |
| 4,869,225 | 9/1989 | Nagata | 123/509 |

FOREIGN PATENT DOCUMENTS

| | | | |
|---|---|---|---|
| 1916565 | 10/1970 | Fed. Rep. of Germany | 123/514 |

*Primary Examiner*—Carl Stuart Miller
*Attorney, Agent, or Firm*—Saul Schwartz

[57] ABSTRACT

A canister with an electric fuel pump therein is connected to a cover for an access port through which the canister is installed on a fuel tank of an automobile by three hollow struts. Each strut has a first end press fitted into a socket on the cover and is telescopically received in a bore in the canister. Coil springs around each strut urge relative separation between the strut and the cover and a flare at a second end of each strut defines a stop to limit relative separation. A passage in the cover from a return fuel connection on an exposed side of the cover to one of the sockets conducts low pressure return fuel to the one of the hollow struts press fitted therein. The return fuel flows back to the canister through the one hollow strut.

5 Claims, 2 Drawing Sheets

MODULAR FUEL DELIVERY SYSTEM

FIELD OF THE INVENTION

This invention relates to modular fuel delivery systems for automobiles.

BACKGROUND OF THE INVENTION

Manufacturing economies are achieved by grouping several functionally related components into a module which is handled and installed as a unit. In automotive fuel systems, for example, modular fuel delivery systems have been proposed for direct installation on a fuel tank. Such modules are typically inserted through a hole in the top of the fuel tank and usually include a reservoir canister, a pump, a fuel level transducer attached to the canister, a cover, and elements for attaching the canister to the cover and for conducting high and low pressure fuel from the canister to the cover. The pump is located inside the canister to avoid momentary fuel starvation during turns and the like when tank fuel level is low and the cover is clamped to the top of the tank to close the hole through which the module is installed. Springs between the cover and the canister bias the latter against a bottom wall of the fuel tank so that fuel level is referenced from the bottom wall. A modular fuel delivery system according to this invention incorporates novel connecting structure between the cover and the canister.

SUMMARY OF THE INVENTION

This invention is a new and improved automotive modular fuel delivery system including a reservoir canister for installation in a fuel tank of the vehicle, an electric pump in the canister, a cover for closing an access hole in a top wall of the fuel tank, and a return fuel connector on the cover to which low pressure excess fuel from the engine is conveyed. The fuel delivery system according to this invention further includes three hollow struts each having an upper end press fitted into one of three symmetrically arrayed sockets in the cover and a lower end telescopically received in one of three similarly symmetrically arrayed bores in the canister. Coil springs are disposed around each strut and bias the canister away from the cover, relative separation between the canister and cover being limited by interference between the canister bores and stops at the bottom ends of the struts. The return fuel connector on the cover has an internal passage to one of the strut sockets so that return fuel is conveyed to the canister through the hollow strut. Each strut further includes an orifice near the cover which prevents backflow from the canister and which defines a flex-point where flexure under extraordinary column or beam loading is concentrated.

DESCRIPTION OF PREFERRED EMBODIMENT

Figure 1:
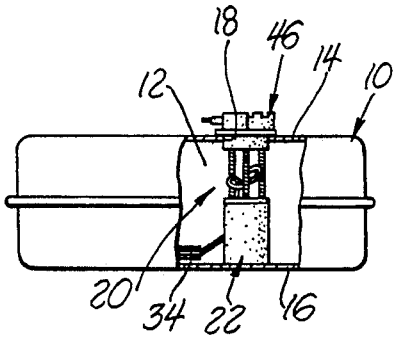
FIG. 1 is a partially broken-away elevational view of an automobile fuel tank having installed thereon a modular fuel delivery system according to this invention.
Figure 2:
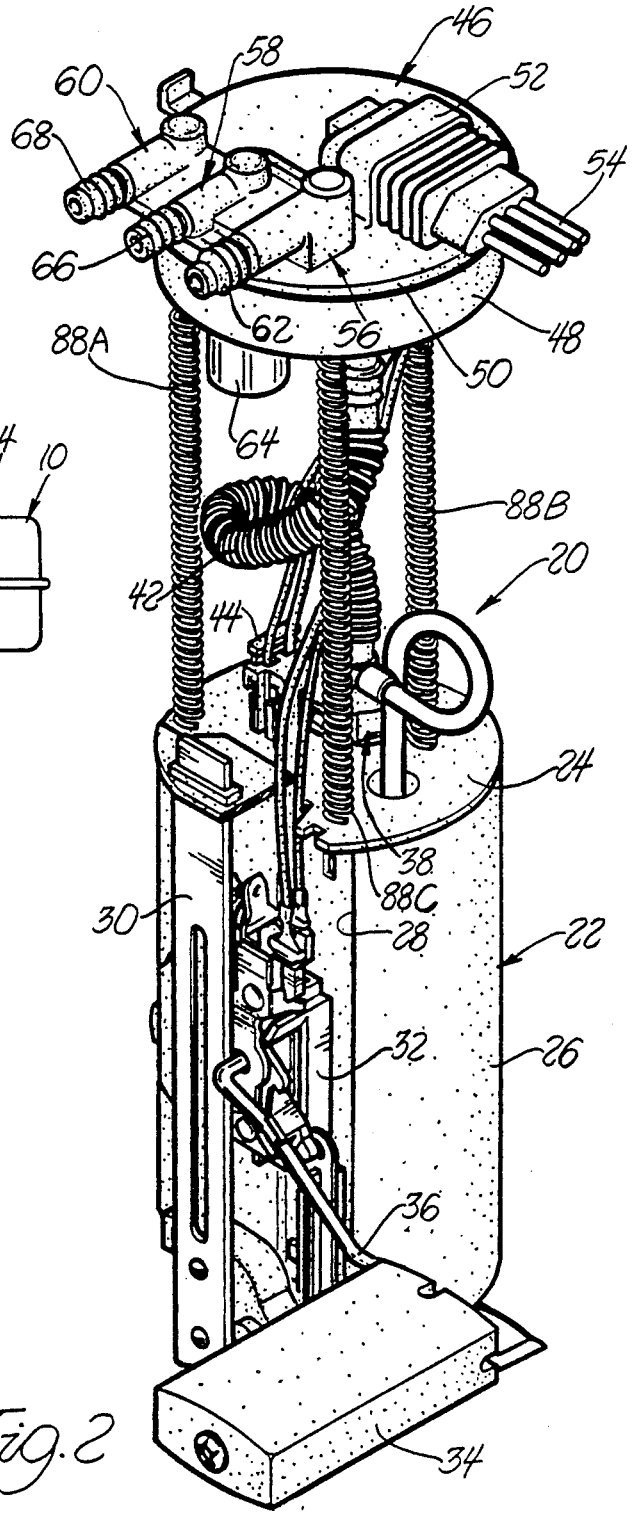
FIG. 2 is an enlarged perspective view of only the modular fuel delivery system according to this invention.

As seen best in FIGS. 1 and 2, a fuel tank 10 of an automobile, not shown, defines a fuel chamber 12 bounded on top by a top wall 14 of the tank and at the bottom by a bottom wall 16 of the tank. The top wall 14 has a hole or access port 18 therein for installation of a modular fuel delivery system 20 according to this invention.

The fuel delivery system 20 includes a reservoir canister 22 having a retainer or top 24 and a cylindrical wall 26 with a flat side 28. A metal bracket 30 is rigidly attached to the canister 22 parallel to the flat side 28. A fuel level transducer 32 is rigidly attached to the bracket 30 between the latter and the flat side 28 and includes a float 34 on an arm 36 which pivots with changes in the surface level of the fuel in the fuel chamber 12. The transducer 32 may be connected to the bracket at various locations to accommodate different fuel tanks.

Figure 3:
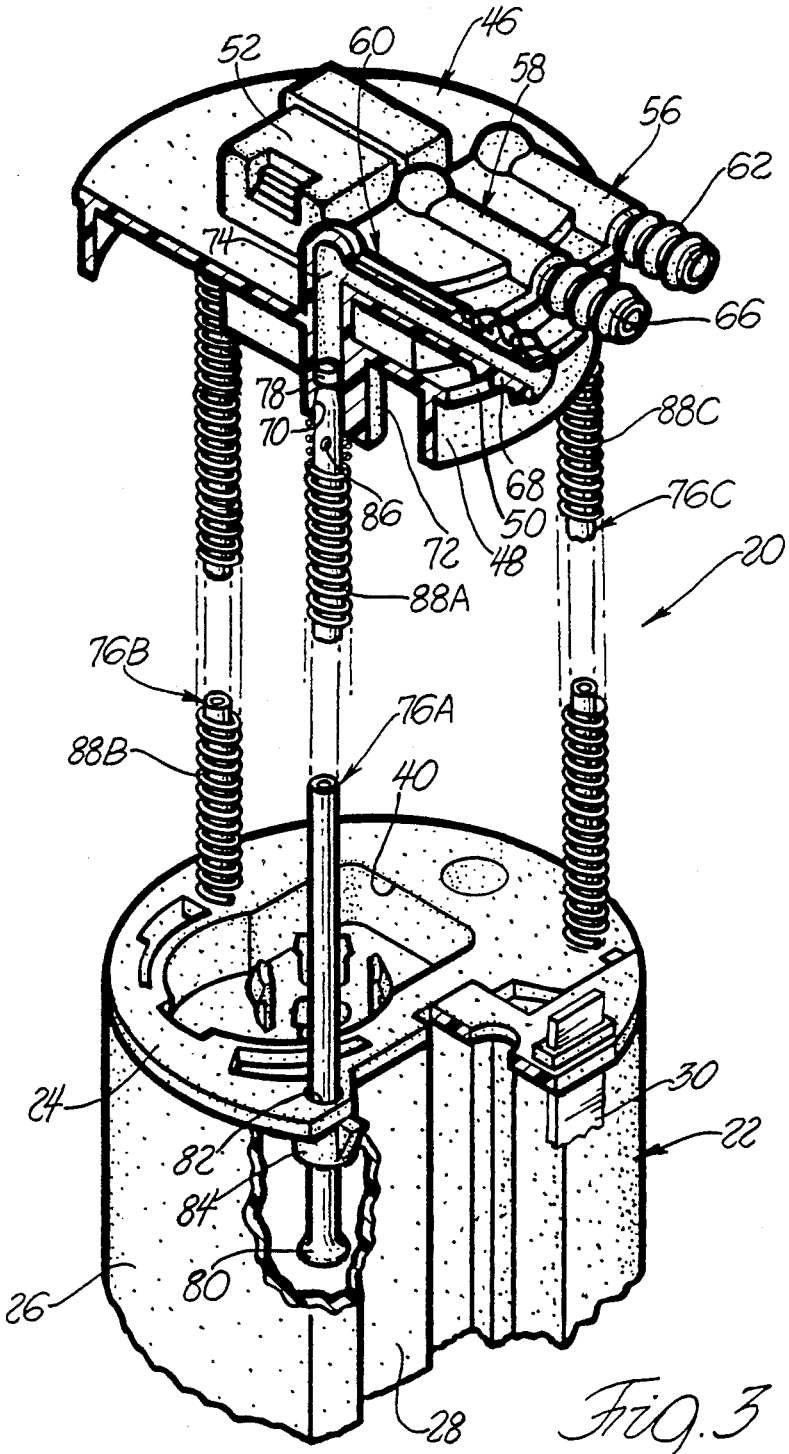
FIG. 3 is a partially broken-away perspective view of a portion of FIG. 2.

A first high pressure connector 38, FIG. 2, is attached to the top 24 in a depression 40, FIG. 3, in the latter. The discharge port of a conventional electric fuel pump, not shown, in the canister 22 communicates with the first high pressure connector 38 below the top 24. The lower end of an intermediate hose 42 is pressed into a barbed end of the connector 38 above the top 24. The electric pump is connected to the electrical system of the automobile through an in-tank portion 44 of the wiring harness of the vehicle. When the ignition of the vehicle is switched on, the pump pumps fuel from inside the canister into to the intermediate hose 42.

The fuel delivery system 20 further includes a cover 46 for closing the hole 18 in the top wall 14 of the tank. The cover 46 is a flat plastic disc having an integral depending flange 48 therearound. The disc has an annular shoulder 50 radially outboard of the depending flange which seats against a seal, not shown, on the top wall 14 of the tank around the hole 18. Conventional means, not shown, clamp the cover 46 to the top wall 14 of the tank. The cover has a molded-in or otherwise sealingly attached electrical connector 52 which defines a junction between the in-tank portion 44 of the wiring harness and an outside portion 54, FIG. 2, of the wiring harness.

The cover 46 has a plurality of molded-in fluid connectors including a high pressure connector 56, a vapor connector 58, and a low pressure or return fuel connector 60. On the side of the cover facing the canister 22, the high pressure connector 56 is attached to the upper end of the intermediate hose 42. On the opposite or exposed side of the cover, the high pressure connector has a barbed tubular end 62 for attachment of a hose, not shown, through which the high pressure fuel discharged from the pump to the intermediate hose is transported to the engine.

On the side of the cover 46 facing the canister 22, the vapor connector 58 is attached to a valve 64, FIG. 2, which is open to the vapor space in the fuel chamber 12 above the fuel in the chamber. On the exposed side of the cover, the vapor connector 58 has a barbed tubular end 66 for attachment of a hose, not shown, through which the vapors from the tank are transported to a charcoal canister, not shown.

On the exposed side of the cover 46, the return fuel connector 60 has a barbed tubular end 68 for attachment of a hose, not shown, through which low pressure excess fuel from the engine is directed back to the fuel tank. On the side of the cover 46 facing the canister 22, the return fuel connector 60 has a cylindrical socket 70 in a boss 72 of the cover, FIG. 3. The socket 70 communicates with the tubular end 68 through a passage 74 of the return fuel connector.

The modular fuel delivery system 20 further includes a plurality of identical hollow struts 76A–C. Each strut has an upset or rounded upper end 78 and a flared lower end 80. The strut 76A is telescopically received in a cylindrical bore 82, FIG. 3, in a boss 84 on underside of the top 24 of the canister 22 within the cylindrical wall 26 of the latter. The upper end 78 of the strut 76A is press fitted into the socket 70 of the return fuel connector 60, the rounded shape of the upper end imparting a degree of angular flexibility to the joint between the strut and the cover so that the strut has limited articulation relative to cover.

The struts 76B, 76C are telescopically received in bores, not shown, in the top 24 of the canister 22 corresponding to the bore 82, the three bores being equally angularly spaced around the top. The upper ends of the struts 76B, 76C are press fitted in molded-in sockets in the cover, not shown, corresponding to the socket 70, the three sockets likewise being equally angularly spaced around the cover 46. Each strut has a pair of cross drilled holes 86 therein, FIG. 3, below the corresponding socket in which the upper end of the strut is received.

Respective ones of a plurality of springs 88A–C are disposed around the struts 76A–C, respectively, between the cover 46 and the top 24 of the canister and urge relative separation therebetween until the stops defined by the flared lower ends 80 of the struts interfere with the bosses 84 around the bores 82. The lengths of the struts 76A–C is coordinated with the vertical depth of the fuel tank 10 between the top wall 14 and the bottom wall 16 such that the springs 88A–C are compressed when the cover 46 is clamped to the top wall. Accordingly, the springs maintain the canister 22 in contact with the bottom wall so that the fuel level signal from the transducer 32 is bottom referenced.

When the ignition of the vehicle is switched on, the fuel pump continuously circulates fuel at high pressure from the canister to the engine and then at low pressure back to the canister through the return fuel connector 60 and the hollow strut 76A. Should a condition exist in which the pressure in the reservoir 22 exceeds the pressure in the return fuel hose or should the canister 22 be filled to capacity, the cross drilled holes 86 in the strut 76A prevent backflow or define orifices through which excess fuel pours directly into the fuel chamber 12, respectively. The cross drilled holes 86 in all of the struts 76A–C also define flex-points on the struts calibrated to concentrate flexure at the holes at predetermined levels of compression and/or bending which might be encountered if the tank 10 is collapsed.

The equal angular distribution of the sockets 70 in the cover 46 and the bores 82 in the top 24 is an important feature because it permits the cover to be angularly indexed through three positions relative to the canister. Thus, for example, a single modular fuel delivery system 20 can be used where one fuel tank is used in several different model vehicles having different fuel line routings and possibly even different tank locations. In each instance, the canister 22 assumes the same position relative to the tank so that recalibration of the transducer 32 is unnecessary while the cover is angularly indexed relative to the canister to achieve the most convenient hose routing.

The embodiments of the invention in which an exclusive property or privilege is claimed are defined as follows:

1. In a modular fuel delivery system for an installation on a fuel tank of an automotive vehicle and including a canister for disposition in said fuel tank, an electric pump disposed in said canister for pumping fuel therefrom to an engine of said vehicle, and a cover for closing an access port in a wall of said fuel tank having an inside surface facing said canister and an exposed surface opposite said inside surface and a low pressure return fuel connector on said exposed surface, the combination comprising:

a plurality of hollow struts, means defining a plurality of sockets on said inside surface of said cover corresponding in number to the number of said struts and evenly angularly arrayed around said inside surface, a first end of each of said struts being press fitted into a respective one of sockets, means on said canister defining a plurality of cylindrical bores corresponding in number to the number of said struts and evenly angularly arrayed around said reservoir canister, said cylindrical bores communicating with the interior of said canister and telescopically receiving respective ones of said struts so that a second end of each of said struts is exposed to the interior of said canister, spring means between said cover and said canister urging relative separation therebetween, means on each of said struts defining a stop at said second end thereof engageable on said canister to limit relative separation between said canister and said cover, and means on said cover defining a passage from said return fuel connector to one of said sockets so that return fuel flows to the interior of said canister through the one of said struts press fitted into said one socket.

2. The modular fuel delivery system recited in claim 1 and further including means on each of said hollow struts defining a flex-point between said cover and said canister operative to concentrate flexure of said struts thereat under extraordinary bending and compression loading.

3. The modular fuel delivery system recited in claim 2 wherein said means on each of said hollow struts defining a flex-point includes a pair of cross drilled holes in each of said struts adjacent the one of said sockets into which each of said struts is press fitted.

4. The modular fuel delivery system recited in claim 3 wherein said spring means between said cover and said canister includes a plurality of coil springs disposed around respective ones of said hollow struts and seating at opposite ends on said canister and on said cover.

5. The modular fuel delivery system recited in claim 2 wherein said means on each of said struts defining a stop at said second end thereof includes means defining a flare at said second end of each of said hollow struts.

* * * * *